US006870073B2

(12) United States Patent
Choi et al.

(10) Patent No.: US 6,870,073 B2
(45) Date of Patent: Mar. 22, 2005

(54) PROCESS FOR SEPARATING NORMAL PARAFFINS FROM HYDROCARBONS AND APPLICATIONS FOR THE SEPARATED HYDROCARBONS

(75) Inventors: Sun Choi, Ulsan (KR); Sung-Joon Lee, Taejon (KR); Sin-Chul Kang, Seoul (KR); Sang-Won Kim, Seoul (KR); Min-Sik Ku, Ulsan (KR); Ahn-Seop Choi, Taejon (KR); Byoung-Mu Chang, Seoul (KR)

(73) Assignee: SK Corporation, Seoul (KR)

( * ) Notice: Subject to any disclaimer, the term of this patent is extended or adjusted under 35 U.S.C. 154(b) by 197 days.

(21) Appl. No.: 10/218,846

(22) Filed: Aug. 13, 2002

(65) Prior Publication Data

US 2003/0100812 A1 May 29, 2003

(30) Foreign Application Priority Data

Nov. 9, 2001 (KR) ..... 2001-69771

(51) Int. Cl.[7] ..... C07C 7/12

(52) U.S. Cl. ..... 585/820; 585/822; 585/825; 585/826

(58) Field of Search ..... 585/820, 822, 585/825, 826; 208/134, 67, 107

(56) References Cited

U.S. PATENT DOCUMENTS

| | | | | |
|---|---|---|---|---|
| 3,422,005 A | | 1/1969 | Avery | 208/310 R |
| 4,006,197 A | | 2/1977 | Bieser | 585/825 |
| 4,036,745 A | | 7/1977 | Broughton | 208/310 Z |
| 4,238,321 A | | 12/1980 | Florack | 208/310 Z |
| 4,350,583 A | | 9/1982 | Fuderer | 208/310 Z |
| 4,354,929 A | | 10/1982 | Wessels et al. | 208/310 Z |
| 4,367,364 A | | 1/1983 | Kulprathipanja et al. | 585/826 |
| 4,374,022 A | | 2/1983 | Fuderer | 585/826 |
| 4,455,444 A | | 6/1984 | Kulprathipanja et al. | 585/826 |
| 4,595,490 A | | 6/1986 | Gray, Jr. et al. | 585/822 |
| 4,992,618 A | | 2/1991 | Kulprathipanja | 585/820 |
| 5,446,229 A | * | 8/1995 | Taylor et al. | 585/648 |
| 5,457,260 A | * | 10/1995 | Holt | 585/820 |
| 5,895,828 A | * | 4/1999 | Yao et al. | 585/418 |
| 6,395,950 B1 | * | 5/2002 | Rice | 585/738 |

* cited by examiner

*Primary Examiner*—Walter D. Griffin
*Assistant Examiner*—Tam M. Nguyen
(74) *Attorney, Agent, or Firm*—Abelman, Frayne & Schwab

(57) ABSTRACT

There is provided with a process for separating normal paraffins from hydrocarbons of $C_{5-10}$ using zeolite molecular sieve 5A, which comprises the steps of (a) selective adsorption (b) cocurrent purge (c) countercurrent desorption. The present process employs butane for purge and desorption step to achieve excellent desorption efficiency and recycles butane in liquid phase to reduce the investment cost. The optimum operating conditions for feedstock change and adsorption capacity reduction are determined by NIR system for on-line monitoring and control. The separated normal paraffins can be efficiently applied to raw material for ethylene production and the separated non-normal paraffins can be efficiently applied to raw material for aromatic hydrocarbons production.

6 Claims, 2 Drawing Sheets

PROCESS FOR SEPARATING NORMAL PARAFFINS FROM HYDROCARBONS AND APPLICATIONS FOR THE SEPARATED HYDROCARBONS

TECHNICAL FIELD

The present invention relates, in general, to a process for separating normal paraffins from hydrocarbons and applications of the separated hydrocarbons. More particularly, the present invention pertains to a process for separating normal paraffins from hydrocarbons comprising: selectively adsorbing normal paraffins to zeolite molecular sieves by upwardly passing $C_{5-10}$ hydrocarbons in gas phase from a bottom of an adsorption column, in which zeolite molecular sieves are loaded; cocurrent-purging the adsorption column with butane after the adsorption step; and desorbing normal paraffins adsorbed to zeolite molecular sieves with butane as a desorbent, and to applications for the separated hydrocarbons.

PRIOR ART

Normal paraffins and non-normal paraffins may be separated from $C_{4-10}$ hydrocarbons by use of zeolite molecular sieve 5A and hydrogen, which serve as an adsorbent and a desorbent, respectively, as disclosed in U.S. Pat. No. 4,595,490. However, when hydrogen is used as the desorbent material, the process disclosed in the above patent is suitable to light fractions such as $C_{5-6}$ hydrocarbons, but unsuitable to heavy fractions such as $C_{7-10}$ hydrocarbons. Low in desorption efficiency with respect to $C_{7-10}$ heavy hydrocarbons, hydrogen is required in a large quantity, which leads to the installation of pipes and related equipments on a larger scale. Also, a compressor, which is generally expensive, is needed to recycle hydrogen for use in the desorption. Further, adsorption columns and pipes must be made of materials resistant to the corrosion properties of hydrogen gas at high temperatures. Thus, the process as mentioned in the above patent is undesirable in economic aspects.

In addition, U.S. Pat. No. 4,238,321 discloses a process for separating normal paraffins from $C_{5-6}$ hydrocarbons with the use of hydrogen as a desorbent material. However, this process also has disadvantages of a reduction of economic efficiency owing to using of hydrogen, and is different from the process of the present invention in view of technical constitution, for example, compositions of raw materials and applications for the separated hydrocarbons.

U.S. Pat. Nos. 3,422,005, 4,374,022, 4,354,929, and 4,350,583 disclose processes for separating normal paraffins in gas phase, comprising the steps of adsorption, purge, and desorption, in which zeolite molecular sieve 5A and n-hexane are used as an adsorbent and a desorbent material, respectively. However, while the processes of the above patents treat $C_{10-15}$ kerosene or $C_{16-25}$ gas oil, the present invention separates normal paraffins from the full range naptha of $C_{5-10}$. Also, the patents as above referenced are different from the present invention in desorbent material and operating conditions. Another difference can be found in that the present invention intends to provide normal paraffins for producing linear alkylbenzene for use in the production of a detergent.

Meanwhile, U.S. Pat. Nos. 4,006,197, 4,036,745, 4,367,364, 4,455,444, and 4,992,618 disclose processes for separating normal paraffins from $C_{6-30}$ hydrocarbons using a simulated moving bed (SMB), which belongs to the adsorptive separation technology capable of being run in the liquid phase. However, the simulated moving bed process, although suitable for the production of highly pure products, has disadvantages in the following aspects. Firstly, it is very difficult to regenerate an adsorbent. Secondly, the feed stream should be subjected to purification such as hydrotreating, in order to remove any significant quantity of sulfur compounds. Thirdly, mass transfer rate in liquid phase is slow in comparison with mass transfer rate in gas phase. Accordingly, if the above process is designed in the same production scale as gas phase processes, larger equipments are required since the usage of the adsorbent increases, and thus causing economic disadvantages.

As described above, prior arts disclose various processes for separating normal paraffins from full range naphtha, kerosene, or gas oil, but require an excessive initial investment. Further, they disclose neither analysis method for obtaining optimum operating conditions of adsorption/desorption nor applications for the separated normal paraffins and non-normal paraffins.

The present inventors have conducted extensive studies, and have developed an improved process for separating normal paraffins from $C_{5-10}$ hydrocarbons, in which excellent economic efficiency is secured, in comparison with the conventional processes, because butane is used as a desorbent, and the process of the present invention is conducted under optimum conditions by using on-line real time analytic techniques such as a NIR (Near InfraRed) system, whereby the separated hydrocarbons may be efficiently applied, for example to raw materials for the production of ethylene and aromatic hydrocarbons.

DISCLOSURE OF THE INVENTION

Therefore, it is an object of the present invention to provide a process for separating high purity of normal paraffins from wide range of hydrocarbons with excellent performance and economic efficiency.

It is another object of the present invention is to provide an application of the normal paraffins separated from the above process to raw materials for producing ethylene with high yield.

It is further object of the present invention is to provide an application of the non-normal paraffins separated in the above process to raw materials for producing aromatic hydrocarbons with high yield.

In accordance with the present invention, there is provided with a process for separating normal paraffins from hydrocarbons, which is carried out in a zone having at least three adsorption columns operating in parallel, the adsorption column being loaded with zeolite molecular sieves, the separation in each of the adsorption columns comprising the following steps of:

a) upwardly passing $C_{5-10}$ hydrocarbons feedstock in gas phase from a bottom of the adsorption column to selectively adsorb normal paraffins contained therein, while passing through unadsorbed non-normal paraffins from the adsorption column;

b) cocurrent-purging the adsorption column with butane to discharge hydrocarbons containing high concentration of non-normal paraffins which remain in void space of the zeolite molecular sieves; and c) countercurrent-desorbing the adsorption column with butane as a desorbent to expel the normal paraffins adsorbed in pores of the zeolite molecular sieves, the steps a), b) and c) in the adsorption columns being cycled in sequence at intervals of switching time in such a way that the separation in the zone is continuously carried out, the switching time being determined by analyzing components of the hydrocarbons feedstock and effluents from the adsorption column through an on-line real time analytic system, wherein a bottom stream comprising normal paraffins and butane, which is the effluent from the step c), is separated by distillation in an extract column, an overhead stream comprising non-normal paraffins and butane, which is the effluent from the steps a) and b), is separated by distillation in a raffinate column, and butane separated through the extract and the raffinate columns is recycled to the adsorption column.

BRIEF DESCRIPTION OF THE DRAWINGS

The above and other objects, features and other advantages of the present invention will be more clearly understood from the following detailed description taken in conjunction with the accompanying drawings, in which.

BEST MODES FOR CARRYING OUT THE INVENTION

Figure 1:
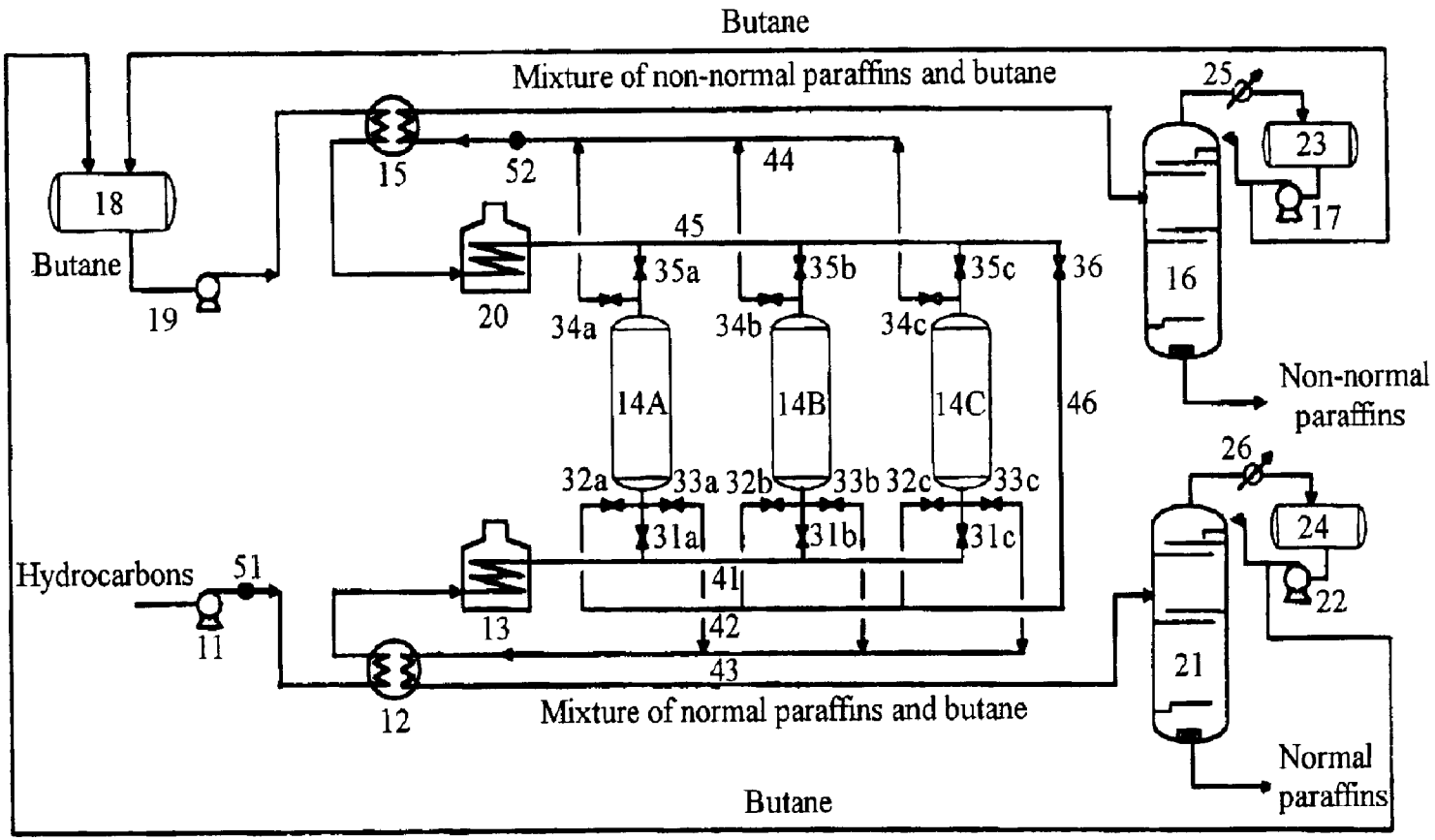
FIG. 1 is a schematic drawing of the separation process of normal paraffins from the full range naphtha in accordance with one embodiment of the present invention.

In accordance with the present invention, $C_{5-10}$ hydrocarbons are employable as a hydrocarbons feedstock. The full range naphtha of $C_{5-10}$ hydrocarbons comprises normal paraffin of 15–35 wt %, iso-paraffin of 20–35 wt %, naphthene of 20–40 wt %, and aromatics of 10–20 wt %. As for the full range naphtha without hydro-desulfurization, sulfur compounds are contained in the range of about 50–500 ppm on the whole. In the present invention, it is preferred that such sulfur compounds is maintained at the level of 300 ppm or less. When the sulfur compounds are present over 300 ppm, a regeneration cycle and a life-time of an adsorbent are shortened due to the excessive formation of coke. Exemplary compositions of the full range naphtha applicable to the present invention are described in Table 1, below.

TABLE 1

(wt %)

| | n-paraffin | iso-paraffin | Naphthen | aromatics | Total |
|---|---|---|---|---|---|
| $C_5$ | 0.20 | 0.04 | 0.11 | | 0.35 |
| $C_6$ | 6.81 | 4.65 | 4.38 | 0.90 | 16.74 |
| $C_7$ | 10.89 | 9.07 | 8.92 | 3.66 | 32.54 |
| $C_8$ | 8.99 | 8.69 | 13.25 | 6.11 | 37.04 |
| $C_9$ | 3.26 | 5.12 | 2.63 | 1.26 | 12.27 |
| $C_{10}$ | | 0.85 | | 0.21 | 1.06 |
| Total | 30.15 | 28.42 | 29.29 | 12.14 | 100.00 |

As described above, naphtha of $C_{5-10}$ hydrocarbons having compositions as exemplified in the Table 1 is fed to an adsorption column maintained at constant temperature and pressure, in which zeolite molecular sieves 5A are loaded, and separated through the following steps into normal paraffins and non-normal paraffins (e.g. iso-paraffin, naphthene, and aromatics):

a) upwardly passing $C_{5-10}$ hydrocarbons feedstock in gas phase from a bottom of the adsorption column to selectively adsorb normal paraffins contained therein, while passing through unadsorbed non-normal paraffins from the adsorption column;

b) cocurrent-purging the adsorption column with butane to discharge hydrocarbons containing high concentration of non-normal paraffins which remain in void space of the zeolite molecular sieves; and c) countercurrent-desorbing the adsorption column with butane as a desorbent to expel the normal paraffins adsorbed in pores of the zeolite molecular sieves.

According to the present invention, a bottom stream containing normal paraffins and butane, which is the effluent from the step c), is separated by distillation through an extract column, and an overhead stream containing non-normal paraffins and butane, which is the effluent from the steps a) and b), is separated by distillation through a raffinate column. Butane separated from the extract and raffinate columns is recycled to the adsorbed column, preferably in liquid phase.

The adsorption column is operated within a temperature range of about 150–400° C. For example, when the temperature is lower than 150° C., a feedstock which has been fed to the adsorption column, cannot be maintained in gas phase. On the other hand, a regeneration cycle and a life-time of an adsorbent become shortened at the temperature above 400° C. because coke is excessively formed. In general, the lower temperature becomes, the higher the adsorption capacity is, but desorption is more difficult to accomplish. On the other hand, the higher the temperature is, the lower the adsorption capacity is, but desorption can be easily accomplished.

It is required that the adsorption column is operated at the pressure of about 5–15 $kg/cm^2g$, so that the feedstock may be maintained in gas phase at the above temperature range. When pressure is too low, there is a need to provide an excessively large scale of pipes and equipments to the process. On the other hand, when the pressure is too high, it is undesirable in terms of economics since more expensive materials should be employed for the equipments.

In accordance with the present invention, the adsorption column is preferably operated at about 250–350° C. under about 8–12 $kg/cm^2,g$. Furthermore, a liquid hourly space velocity (LHSV) of the feedstock is in the range of about 1–10 $hr^{-1}$, preferably about 1–6 $hr^{-1}$ and more preferably about 2–4 $hr^{-1}$.

In addition, the hydrocarbons feedstock and butane fed into the adsorption column are heated to about 270–330° C. by use of heating means such as a heat exchanger and a heating furnace to be entirely vaporized. For example, the hydrocarbons feedstock and butane may be firstly heated to about 150–250° C. through the heat exchanger, and then further heated to about 270–330° C. through the heating furnace.

As a result of the separation, the bottom stream of the adsorption column comprises butane (about 50–70%) and normal paraffins, and the overhead stream comprises butane (about 10–20%) and non-normal paraffins. The bottom stream and the overhead stream are separated through a distillation in extract and raffinate columns, respectively to purify/recover hydrocarbon components thereof and butane, for example under the condition of about 60–200° C. and about 6–8 $kg/cm^2,g$.

As a result, normal paraffins have a purity of 95% or higher and can be recovered at 93% or higher yield, while non-normal paraffins have a yield of 98% or higher. Further, 99.9% or more of butane can be recovered and recycled to the adsorption column. According to the present invention, it is preferred that butane employable in the cocurrent-purge/desorption comprises 70–100 wt % of normal butane.

A more detailed description of the present invention will be given with reference to accompanying drawing.

FIG. 1 schematically illustrates the separation of normal paraffins from non-normal paraffins (iso-paraffin, naphthen, and aromatics) in the full range naphtha of $C_{5-10}$ according to an embodiment of the present invention.

Referring to FIG. 1, $C_{5-10}$ naphtha is fed into a process of the present invention by use of a pump 11 under pressure of about 10–20 kg/cm$^2$,g. Naphtha is heated to about 150–250° C. through a heat exchanger 12 and then further heated to about 270–330° C. through a heating furnace 13 to be entirely vaporized.

Thereafter, the vaporized naphtha is fed through pipe 41 and control valve 31*a* into the adsorption column 14A in which zeolite molecular sieves 5A are loaded. The vaporized naphtha feedstock is upwardly passed through the adsorption column under the pressure of 5–15 kg/cm$^2$,g so that normal paraffins in the naphtha may be selectively adsorbed into the zeolite molecular sieves 5A. Initially, normal paraffins are adsorbed in the vicinity of the bottom inlet of the adsorption column 14A. As the adsorption goes on, the adsorption front upwardly move toward the upper end of the adsorption column 14A, substituting butane adsorbed into zeolite molecular sieves in the previous step, i.e., desorption, with normal paraffins.

Non-normal paraffins comprising iso-paraffin, naphthen, and aromatics, which are not adsorbed into the zeolite molecular sieve 5A, are passed through out of the adsorption column 14A and transferred into pipe 44 through the manipulation of control valve 34*a*. The effluent from the adsorption column 14A during the adsorption step contains butane having remained in the zeolite molecular sieves 5A as a result of desorption of normal paraffins. The feeding of the full range naphtha is interrupted by closing the control valve 31*a* at a predetermined time according to adsorption capacity of the adsorbent.

The effluent from the adsorption column 14A during the adsorption step is mixed with the effluent from the adsorption column 14A in the cocurrent-purge step, as will be described later to constitute an overhead stream. The overhead stream contains butane at an amount of about 10–20%, and is supplied into a heat exchanger 15 through control valve 34*a* and pipe 44 to be cooled to about 60–200° C. by heat exchange with coolant, i.e., butane of liquid phase. The cooled overhead stream is transferred to a raffinate column 16, which is operated at about 6–8 kg/cm$^2$,g. In the raffinate column, the non-normal paraffins are separated and discharged therefrom as a bottom fraction. The raffinate column 16 has sufficient number of theoretical plates to recover butane as an overhead fraction thereof. Thus, the bottom fraction is substantially free of butane, whereby it can meet the particular specification of non-normal paraffins. Butane as overhead fraction is condensed through the heat exchanger 25 and is transferred to a recycle drum 18.

In the present invention, one of the important features reside in recycling butane in liquid phase, which is advantageous in that an expensive compressor used to transfer butane gas is unnecessary and most equipments including pipes, which are required for the separation process, have a relatively small size because of employing butane in liquid phase. Thus, the process of the present invention is economically superior to a similar process in which gas such as hydrogen, methane and nitrogen is used in a purging or a desorbing step.

Butane from the recycle drum 18 is supplied to the heat exchanger 15 through a pump 19 under about 10–20 kg/cm$^2$, g, and then heated to about 150–250° C. through the heat exchanger 15, and thereafter is further heated to about 270–330° C., which is an operating temperature range of the adsorption column, through the heating furnace 20. The heated butane is supplied to a zone, in which the separation of normal paraffins from non-normal paraffins are carried out, through a pipe 45 for the cocurrent-purge and countercurrent-desorption. Furthermore, butane may be additionally supplied to the recycle drum 18, if required.

When the adsorption step is completed, butane from the recycle drum 18 is fed in the same direction as the previously flowing naphtha feedstock, i.e., cocurrently, into the adsorption column 14A through pipe 45, control valve 36, pipe 42, and control valve 32*a*. Butane supplied into the adsorption column 14A pushes hydrocarbons, which remain in void space of the zeolite molecular sieves, toward the upper end of the adsorption column 14A, and discharge them through outlet of the adsorption column. Such hydrocarbons comprise non-normal paraffins, which are not discharged in the adsorption step. The effluent in the cocurrent-purge step is transferred into pipe 44 through control valve 34*a*, then mixed with the effluent from the adsorption step to constitute an overhead stream and transferred to heat exchanger 15.

When the cocurrent-purge is completed, butane transferred from the recycle drum 18 through heat exchanger 15 is further heated to about 270–330° C. by use of heating furnace 20 to be entirely vaporized, and then fed into the upper end of the adsorption column 14A through pipe 45 and control valve 35*a* for the countercurrent-purge. This countercurrent-purge desorbs the normal paraffins adsorbed in pores of the zeolite molecular sieves 5A, and transfers the resulting bottom stream comprising normal paraffins and butane to pipe 43 through control valve 33*a*.

The bottom stream from the desorption transferred to pipe 43 contains the desorbed normal paraffins and butane as a desorbent, and the butane content therein ranges within about 50–70 wt %. The bottom stream is cooled to about 80–120° C. through the heat exchanger 12 and fed to extract column 21. In the extract column, the bottom stream may be separated into normal paraffins and butane by distillation in the similar manner as the raffinate column. The separated butane as an overhead fraction of the extract column is condensed through the heat exchanger 26, and is supplied to a recycle drum 18. Since the extract column 21 has sufficient number of theoretical plates to obtain butane as an overhead fraction, the bottom fraction is substantially free of butane, and thus it may meet the particular specification of normal paraffins.

As aforementioned, the separation process according to the present invention has been described, in the order of adsorption/purge/desorption of the adsorption column 14A. However, it is apparent that such adsorption/purge/desorption steps may also be carried out in other adsorption columns 14B and 14C, in which zeolite molecular sieves 5A are charged. According to an embodiment as illustrated in the FIG. 1, the adsorption columns 14A, 14B and 14C are arranged in parallel with one another.

Since normal paraffins and non-normal paraffins can only be produced intermittently with one adsorption column, at least three adsorption columns should be employed to achieve continuous production required in the commercial processes. In this case, while the first adsorption column is on the adsorption step, second column is being cocurrent-purged and the third column is being used for the countercurrent-desorption. Thus, both normal paraffins and non-normal paraffins may be continuously produced by means of the three-steps process as above. At this time, it is important to switch the adsorption/purge/desorption steps at proper time intervals in the adsorption column.

To continuously produce normal paraffins and non-normal paraffins, preferably, adsorption time is the same as desorption time, and purging time is half of the adsorption/desorption time. Therefore, it is preferable that a total of six adsorption columns are set in the process, for example, two columns in the adsorption step, one column in the purge step, two columns in the desorption step, and one stand-by column for regeneration or emergency.

According to the present invention, an adsorbent, which can preferentially adsorb normal paraffins rather than non-normal paraffins and can be applied to a practical use, is preferable. For example, a zeolite molecular sieve is useful as the adsorbent of the present invention. Because a minimum cross-sectional diameter of normal paraffin molecules is on the order of about 5 Å, it is recommendable to employ a zeolite molecular sieve 5A with a pore diameter of about 5 Å in the present invention.

In accordance with the present invention, although hydrogen, nitrogen, or hydrocarbons with few carbons, such as methane and propane may be used as the desorbent, most preferable desorbent is butane. Hydrogen, nitrogen, or hydrocarbons with few carbons, such as methane and propane may be commercially used as the desorbent, as they are small-sized molecules capable of entering into pores of a zeolite molecular sieve particle, but hardly adsorbed in the zeolite molecular sieve. However, hydrogen and nitrogen should be consumed in large amounts to achieve sufficient desorption due to its weak adsorption nature. Also, methane and propane are insufficient to desorb normal paraffins of $C_8$ or higher due to their relatively weak adsorption nature, in comparison with normal butane.

In case of using butane as the desorbent, butane may be recycled in liquid phase. Therefore, a process for separating normal paraffin from hydrocarbons of the present invention has advantages in that an expensive compressor used to transfer butane gas is unnecessary, and in that equipments and pipes required for the process have a relatively small size, whereby the process of the present invention economically superior to a process using other gases such as hydrogen, methane, nitrogen as a desorbent. Furthermore, a production efficiency is increased because desorption rate is increased.

Preferably, a purity of normal butane is 70 to 99%, and commercial butane comprises normal butane of 93% and iso-butane of 6%. Normal butane has a boiling point of −0.5° C., which is widely different from a boiling point of iso-pentane, i.e. 28° C., which has the lowest boiling point in full range naphtha, and thus normal butane can be readily separated by distillation.

In case of determining optimum switching time between adsorption columns, the two important variables are a change of a normal paraffin content in the hydrocarbons feedstock and a reduction of an adsorption capacity of zeolite molecular sieve, which is attributable to repetitions of adsorption and desorption or regeneration as the operation goes on. The economic efficiency of the adsorptive separation process depends on the control of the above two variables. At the same flow rate and composition, when a switching time is short in comparison with optimum switching time, a yield is reduced because the adsorption column cannot utilize the adsorption capacity thereof sufficiently. In addition, products may be contaminated because a concentration front of normal paraffin cannot reach an outlet of the adsorption column. On the other hand, when the switching time is too long, a degree of recovery is reduced although a purity of products is increased, because the concentration front of normal paraffins breaks through the top of the adsorption column.

Optimum switching time can be determined in the two aspects. A first aspect is to establish a process model, in which optimum time for specific feedstock and process conditions is calculated by measuring normal paraffin contents in the feedstock. A second aspect is to determine a switching time of the adsorption column before normal paraffins are contaminated by monitoring a content of adsorbed components (normal paraffin). For these, it is required to take advantage of an on-line technology, which is able to analyze fast and precisely a content of normal paraffins in the hydrocarbons feedstock or normal paraffin products.

Generally, gas chromatography analysis is used to analyze a content of normal paraffins. However, gas chromatography analysis generally takes 20 min or more, but switching time of the adsorption column is in the range of 2–10 min. Thus, the gas chromatography analysis has disadvantages in that it takes excessively long time to perceive a performance change of the process stemming from change of the feedstock or performance reduction of the adsorbent and to optimize operating variables of the process.

According to the present invention, however, a content of normal paraffins in the full range naphtha and effluents from the adsorption column is analyzed in real-time, and optimum switching time is determined from analysis results which are obtained by employing a NIR (Near InfraRed) system not only having short analysis time but also showing excellent reproducibility and reliability as an on-line analyzer. The NIR system measures a content of normal paraffins on-line by transmitting a NIR (wavelength: 1100 to 2500 nm) through optical fibers. For example, with reference to FIG. 1, the NIR system picks up one sample at a sampling position 51 for measuring a content of normal paraffins in the feedstock upstream of the adsorption column, and the other sample at a sampling position 52, through which a mixture of non-normal paraffins and butane is passed. In the embodiment as described above, the NIR system is designed in such a way that two samples are simultaneously measured by use of a single NIR analyzer. Therefore, The process in accordance with the present invention is controlled so that a content of normal paraffins does not exceed the standard level by measuring a content of normal paraffins in non-normal paraffins at sampling point 52.

In the present invention, the conventional NIR analyzer can be used without limitations. With characteristic absorption bands, hydrocarbons are detected by overtone and combination absorption bands appearing in the near infrared region of the analyzer. In case of a mixture of hydrocarbons, its composition analysis resorts to a statistical multi-variate regression method because their characteristic absorption bands are overlapped.

Figure 2:
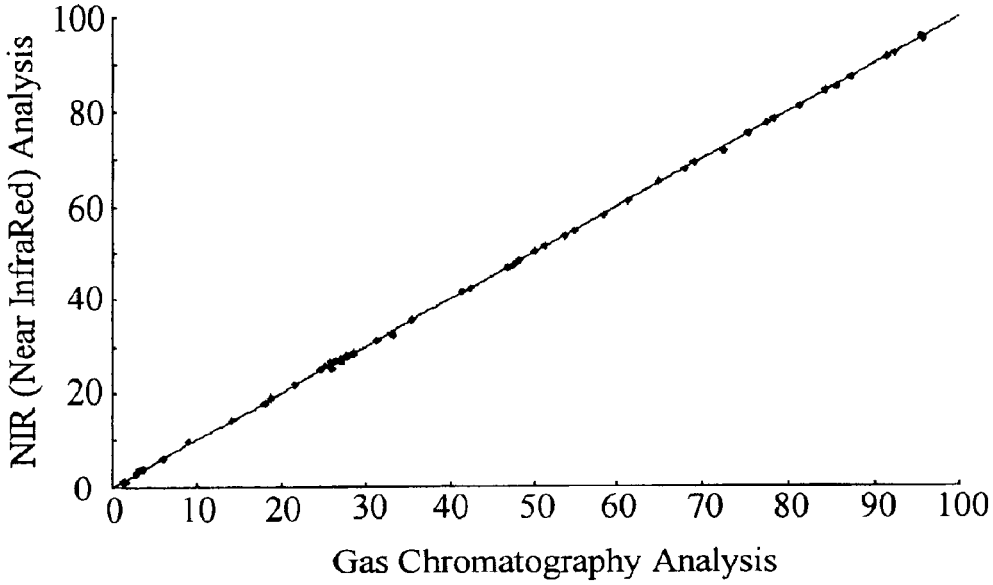
FIG. 2 is a graph illustrating correlation between NIR analysis results and the conventional gas chromatography (GC) analysis results for the detection of normal paraffins in the present invention.

With reference to FIG. 2, correlation between gas chromatography analysis results and the NIR results of normal paraffins are plotted. As seen in the plot, the analysis by the NIR system is precise with a forecasting error range of ±0.5%. Accordingly, operation variables of the process can be controlled by finding optimum operating conditions while monitoring the process with the use of the NIR system.

Ethylene, a basic hydrocarbon in petrochemistry, can be produced from raw gas comprising ethane as a main component, or from naphtha of $C_{5-10}$ hydrocarbons. In case of producing ethylene from naphtha through an ethylene thermal cracking reaction, as paraffin components—particularly normal paraffins—in raw materials to be fed into an ethylene thermal cracking furnace are increased, a yield of ethylene is increased. On the other hand, naphthene and aromatic components cannot increase a yield of ethylene.

In view of the above, it will be appreciated that a content of normal paraffins in raw materials to be fed into the ethylene thermal cracking furnace may be increased by using normal paraffins alone, separated according to the present invention, or by using a mixture of the traditional raw materials and such normal paraffins, in a process for preparing ethylene, whereby a yield of ethylene can be improved.

Meanwhile, non-normal paraffins mainly comprise naphthene and aromatics. When the non-normal paraffins are fed into a catalytic reforming reactor of a process for preparing aromatic hydrocarbon, aromatics are unaffected but naphthene is converted to aromatics, thereby a yield of aromatic hydrocarbons is increased.

A better understanding of the present invention may be obtained in light of the following examples which are set forth to illustrate, but are not to be construed to limit the present invention.

EXAMPLE 1

A procedure was monitored on-line, in which full range naphtha having compositions of the following Table 1 was fed into a fixed bed adsorption column with an inside diameter of 5.08 cm and a length of 53 cm to separate normal paraffins from the naphtha. The adsorption column, in which zeolite molecular sieve 5A was charged, was operated under conditions of a temperature of 300° C., a pressure of 10 kg/cm$^2$,g, and a liquid hourly space velocity of the feedstock (LHSV) of 2 hr$^{-1}$.

The full range naphtha upwardly passed from a bottom of the adsorption column for 15 min, and a normal paraffin content in an effluent from the adsorption column was monitored on-line every 20 seconds with the use of a NIR analytical system set at the outlet of the adsorption column. The results are plotted in FIG. 3.

Figure 3:
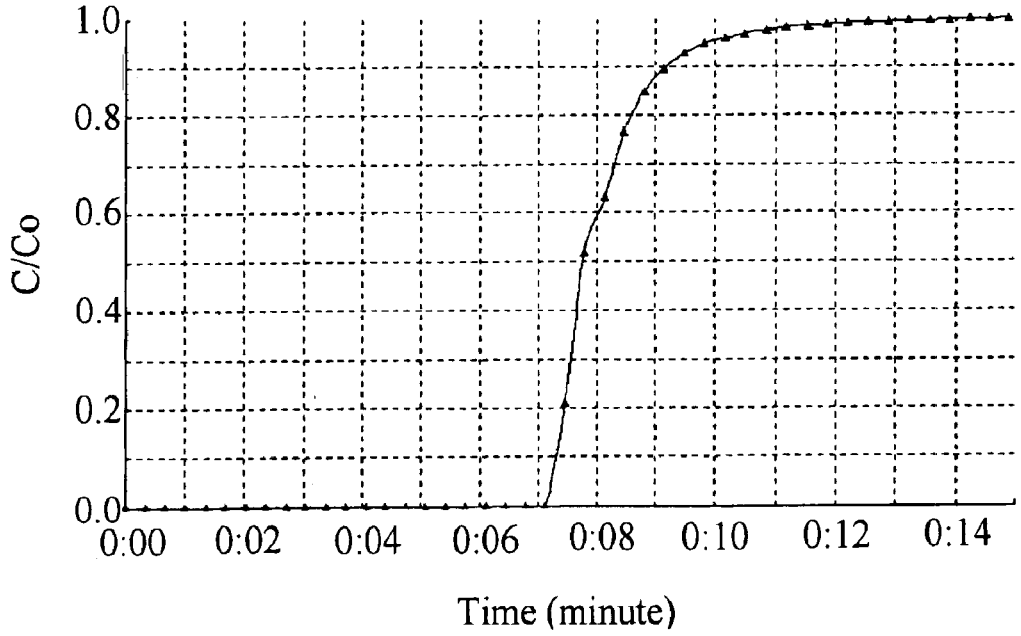
FIG. 3 is a graph illustrating a breakthrough curve of normal paraffins separated from the full range naphtha using the adsorption column loaded with zeolite molecular sieves in accordance with the present invention.

In FIG. 3, the x-axis indicates operating time of the adsorption column and the y-axis indicates a ratio of the normal paraffin content in the effluent to the normal paraffin content in the full range naphtha. The ratio measured 0 for 7 minutes after the full range naphtha was fed into the adsorption column, which means that no normal paraffins were discharged from the adsorption column because normal paraffins in the full range naphtha were totally adsorbed into a zeolite molecular sieve. On the other hand, the ratio measured 1 after 12 minutes, which means that all normal paraffins were discharged to an outside of the adsorption column because the zeolite molecular sieve was saturated with normal paraffins. Accordingly, the optimum adsorption time is considered as a range of 7 min or less under the above operating conditions.

EXAMPLE 2

The adsorption was conducted in the same manner as described in Example 1, except adsorption time of 5 min. Thereafter, the column was purged with butane as a desorbent fed cocurrently into the column for 2.5 min, i.e., half the adsorption time. Next, desorption was conducted for 5 min by feeding butane into the column countercurrently. The results are described in Table 2, below.

COMPARATIVE EXAMPLE 1

The present example was carried out in the same manner as described in Example 2, except that hydrogen was used as a desorbent, the adsorption was conducted for 15 min, and then the adsorption column was purged with hydrogen fed into the column in cocurrent for 7.5 min, i.e., half the adsorption time. Thereafter, the desorption was conducted for 15 min by feeding hydrogen into the column countercurrently. The results are described in Table 2, below.

COMPARATIVE EXAMPLE 2

The procedure of Example 2 was repeated except that propane was used as the desorbent. The results are described in Table 2, below.

TABLE 2

| | Example 2 | Comp. Exam. 1 | Comp. Exam. 2 |
|---|---|---|---|
| Operating temperature (° C.) | 300 | 300 | 300 |
| Operating Pressure (Kg/cm$^2$, g) | 10 | 10 | 10 |
| Adsorption time (min) | 5 | 15 | 5 |
| Desorption time (min) | 5 | 15 | 5 |
| Purge time (min) | 2.5 | 7.5 | 2.5 |
| Flow amount of desorbent material (NM$^3$/hr) | 0.86 | 1.50 | 1.25 |
| [1]Desorption performance (g/cc/min) | 0.0116 | 0.0043 | 0.0078 |

[1]Desorption performance (g/cc/min): A desorbed normal paraffin amount (g) to a flow amount of desorbent (cc) per time (min).

As apparent from the result shown in Table 2, it can be seen that when hydrogen was used as the desorbent, a desorption performance was lower in comparison with the case of desorbing with propane or butane, even though the whole cycle time in the case of using hydrogen was two times longer than the cycle time in the case of using butane or propane. Furthermore, in case of using butane instead of propane, it was confirmed that the desorption performance was increased by about 49%, while the required amount of butane for desorption was reduced by about 69%.

EXAMPLE 3 AND COMPARATIVE EXAMPLE 3

To confirm a practical use of normal paraffins separated from full range naphtha, Example 3 and Comparative Example 3 were carried out. Naphtha used in ethylene thermal cracking furnace in Comparative Example 3 has a specific gravity of about 0.7, an initial boiling point of about 36° C., a 95% distillation point of about 114° C., and consists of normal paraffin of about 45%, iso-paraffin of about 41%, naphthene of about 11%, and aromatics of about 3%. In Comparative Example 3, the full range naphtha itself was introduced to the ethylene thermal cracking furnace. On the other hand, in Example 3, normal paraffins separated from full range naphtha according to the present invention were introduced to the ethylene thermal cracking furnace. Compositions of products are described in Table 3, below.

Example 3 and Comparative Example 3 were carried out in a thermal cracking pilot with an inside diameter of 0.68 cm and a length of 69 cm under conditions of a temperature of 850° C., a pressure of 0.5 kg/cm$^2$, g, a dilution steam ratio of 0.5, and retention time of 0.22 sec. A yield of ethylene was increased by 10.45%, as described in Table 3.

TABLE 3

| Components | Comparative example 3 | Example 3 |
|---|---|---|
| Hydrogen | 0.86 | 0.81 |
| Methane | 14.61 | 11.87 |
| Other gases | 5.04 | 5.71 |
| Ethylene | 31.12 | 41.57 |
| Propylene | 16.09 | 15.94 |
| Propane | 0.32 | 0.41 |
| C4 | 10.46 | 8.78 |
| C5 | 5.08 | 4.01 |
| C6+ | 16.42 | 10.90 |
| Total | 100.00 | 100.00 |

EXAMPLE 4 AND COMPARATIVE EXAMPLE 4

As for a practical use of non-normal paraffins separated from full range naphtha, Example 4 and Comparative Example 4 were carried out. Generally, raw materials fed in a catalytic reforming reactor for producing aromatic hydrocarbons comprise $C_7$ to $C_9$ as a main component, typically, normal paraffins of about 27%, iso-paraffins of about 31%, naphthene of about 28%, and aromatics of about 14%. In Comparative Example 4, the full range naphtha itself was introduced to a catalytic reforming pilot for producing aromatic hydrocarbons. On the other hand, in Example 4, non-normal paraffins separated from full range naphtha according to the present invention were introduced to a catalytic reforming pilot for producing aromatic hydrocarbons. Compositions of products are described in Table 4, below.

Example 4 and Comparative Example 4 were carried out in a catalytic reforming reactor with an inside diameter of 1.9 cm and a length of 60 cm, in which R-134 catalyst of UOP was charged, under conditions of a ratio of hydrogen/naphtha (mole ratio)=4.1, a waited average inlet temperature of 501° C., a pressure of 32 kg/cm$^2$, g, and a liquid hourly space velocity of raw materials of 2.4 hr$^{-1}$. A whole yield of aromatic hydrocarbons was increased by 12.35%, as described in Table 4.

TABLE 4

| Components | Comparative example 4 | Example 4 |
|---|---|---|
| Hydrogen | 2.51 | 2.68 |
| Liquified petroleum gas | 8.42 | 7.50 |
| Benzene | 5.33 | 4.92 |
| Toluene | 11.11 | 17.54 |
| Xylene | 26.46 | 32.79 |
| Raffinate | 24.00 | 11.49 |
| C9+ | 22.17 | 23.08 |
| Total | 100.00 | 100.00 |

As described above, a process for separating normal paraffins from hydrocarbons feedstock according to the present invention has advantages in that excellent desorption performance and economic efficiency can be obtained because butane is used as a desorbent in order to purge the adsorption column and desorbe adsorbed normal paraffins, an amount invested to equipments can be reduced because butane is recovered in liquid phase, and the process is monitored and controlled on-line in real time by use of a NIR analytical system. Moreover, other advantages of the present invention are that a yield of ethylene is increased without further ethylene processing because normal paraffins separated from the process of the present invention are used as raw materials in an ethylene thermal cracking furnace, and a yield of aromatic hydrocarbons is increased without further aromatics processing because non-normal paraffins from the process of the present invention are used as raw materials in a catalytic reforming reactor.

The present invention has been described in an illustrative manner, and it is to be understood that the terminology used is intended to be in the nature of description rather than of limitation. Many modifications and variations of the present invention are possible in light of the above teachings. Therefore, it is to be understood that within the scope of the appended claims, the invention may be practiced otherwise than as specifically described.

What is claimed is:

1. A process for separating normal paraffins from hydrocarbons, which is carried out in a zone having at least three adsorption columns operating in parallel, the adsorption column being loaded with zeolite molecular sieves, the separation in each of the adsorption columns comprising the following steps of:

a) upwardly passing $C_{5-10}$ hydrocarbons feedstock in gas phase from a bottom of the adsorption column to selectively adsorb normal paraffins contained therein, while passing through unadsorbed non-normal paraffins from the adsorption column;

b) cocurrent-purging the adsorption column with butane to discharge hydrocarbons containing high concentration of non-normal paraffins which remain in void space of the zeolite molecular sieves; and c) countercurrent-desorbing the adsorption column with butane as a desorbent to expel the normal paraffins adsorbed in pores of the zeolite molecular sieves, the steps a), b) and c) in the adsorption columns being cycled in sequence at intervals of switching time in such a way that the separation in the zone is continuously carried out, the switching time being determined by analyzing components of the hydrocarbons feedstock and effluents from the adsorption column through an on-line real time analytic system, wherein a bottom stream comprising normal paraffins and butane, which is the effluent from the step c), is separated by distillation in an extract column, an overhead stream comprising non-normal paraffins and butane, which is the effluent from the steps a) and b), is separated by distillation in a raffinate column, and butane separated from the extract and the raffinate columns is recycled to the adsorption column.

2. The process as set forth in claim 1, wherein butane comprising 70 to 100 wt % of normal butane is used during the steps b) and c).

3. The process as set forth in claim 1, wherein the steps a), b) and c) are carried out at a temperature of 150 to 400° C. and a liquid hourly space velocity of the feedstock of 1 to 10 hr$^{-1}$ under a pressure of 5 to 15 kg/cm$^2$,g.

4. The process as set forth in claim 1, wherein said on-line real time analytic system is a Near InfraRed (NIR) system.

5. The process as set forth in claim 1, further comprising supplying the normal paraffins separated through the extract column to an ethylene thermal cracking furnace as raw materials for production of ethylene.

6. The process as set forth in claim 1, further comprising supplying the non-normal paraffins separated through the raffinate column to a catalytic reforming reactor as raw materials for production of aromatic hydrocarbons.

* * * * *